US008149563B2

(12) United States Patent
Huang

(10) Patent No.: US 8,149,563 B2
(45) Date of Patent: Apr. 3, 2012

(54) IGNITION CIRCUIT

(75) Inventor: Yong-Zhao Huang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 303 days.

(21) Appl. No.: 12/560,447

(22) Filed: Sep. 16, 2009

(65) Prior Publication Data

US 2011/0058304 A1 Mar. 10, 2011

(30) Foreign Application Priority Data

Sep. 7, 2009 (CN) ..... 2009 1 0306649

(51) Int. Cl.
*F23Q 3/00* (2006.01)

(52) U.S. Cl. ..... 361/256; 361/263

(58) Field of Classification Search ..... 361/247, 361/256, 257, 263, 264
See application file for complete search history.

(56) References Cited

U.S. PATENT DOCUMENTS 4,329,950 A * 5/1982 Orova et al. ..... 123/406.56
4,664,080 A * 5/1987 Minks ..... 123/335
4,817,577 A * 4/1989 Dykstra ..... 123/406.56

* cited by examiner

*Primary Examiner* — Danny Nguyen
(74) *Attorney, Agent, or Firm* — Altis Law Group, Inc.

(57) ABSTRACT

An ignition circuit includes a system power supply, an ignition coil, a delay unit, a first switch unit, and a second switch unit. When the system power supply is powered on, the second switch unit is turned on, the ignition coil is powered on. After a delay time, the delay unit controls the first switch unit to be turned on, the second switch unit is turned off, the ignition coil is powered off. Therefore an ignition operation is accomplished.

8 Claims, 3 Drawing Sheets

IGNITION CIRCUIT

BACKGROUND

1. Technical Field

The present disclosure relates to circuits and, particularly, to an ignition circuit.

2. Description of Related Art

All cars include ignition circuits for starting the engines. Ordinary ignition circuits may be complicated and expensive, for example, an ordinary ignition circuit may include an LM431 programmable shunt regulator, a voltage regulator, etc.

DETAILED DESCRIPTION

Figure 1:
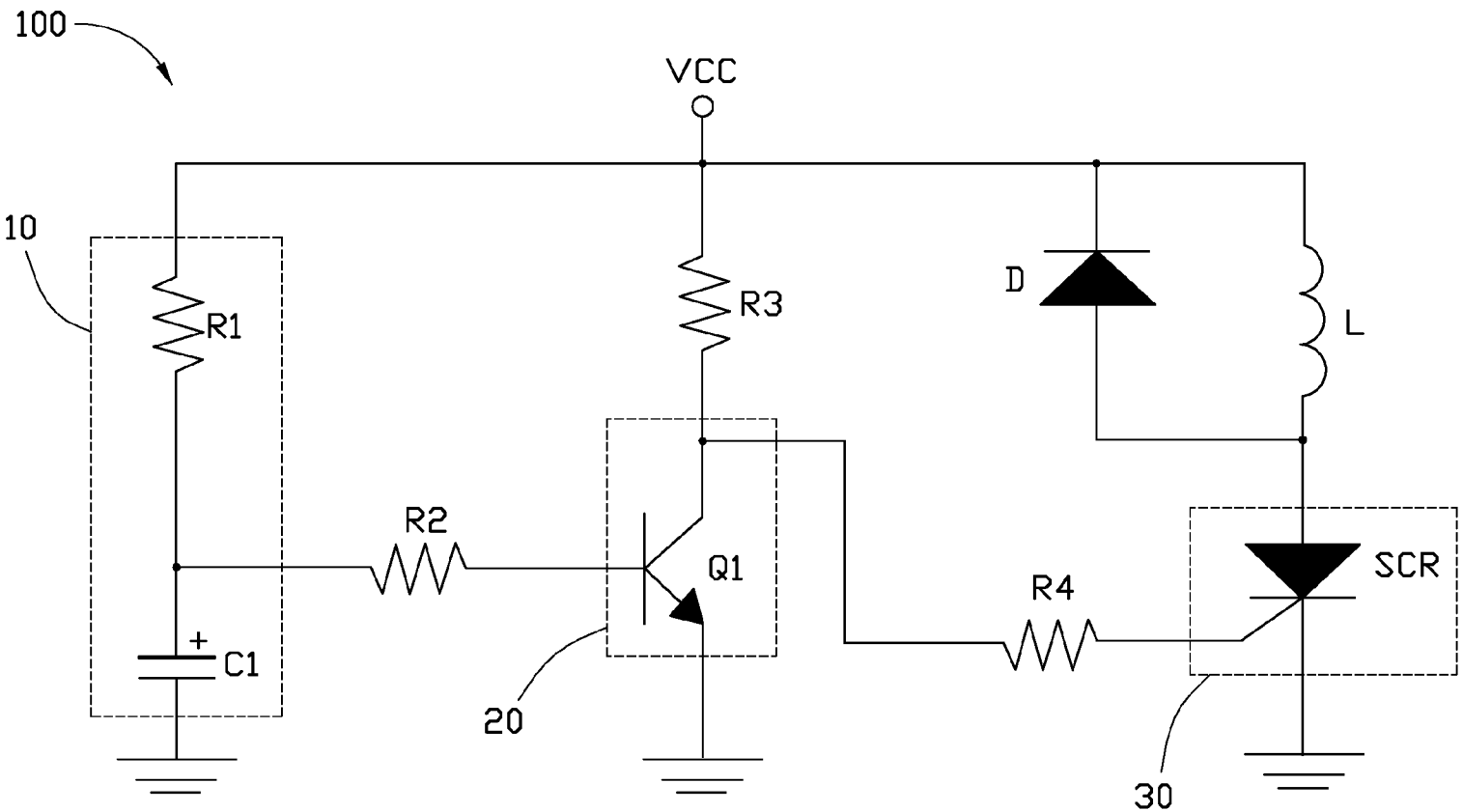
FIG. 1 is a circuit diagram of a first exemplary embodiment of an ignition circuit.

Referring to FIG. 1, a first exemplary embodiment of an ignition circuit 100 includes a system power supply VCC, a delay unit 10 including a resistor R1 and a capacitor C1, a first switch unit 20, a second switch unit 30, an ignition coil L, a diode D, and three resistors R2-R4. The first switch unit 20 includes an npn transistor Q1. The second switch unit 30 includes a thyristor SCR.

The system power supply VCC is connected to a positive terminal of the capacitor C1 via the resistor R1. A negative terminal of the capacitor C1 is grounded. A base of the transistor Q1 is connected to a node between the resistor R1 and the capacitor C1 via the resistor R2. An emitter of the transistor Q1 is grounded. A collector of the transistor Q1 is connected to the system power supply VCC via the resistor R3. The system power supply VCC is also connected to an anode of the thyristor SCR via the ignition coil L. A cathode of the thyristor SCR is grounded. A control terminal of the thyristor SCR is connected to the collector of the transistor Q1 via the resistor R4. A cathode of the diode D is connected to the system power supply VCC. An anode of the diode D is connected to the anode of the thyristor SCR.

In use, when the system power supply VCC is powered on, the system power supply VCC charges the capacitor C1 via the resistor R1. Because the resistance of the resistor R1 is very large, a voltage of the capacitor C1 is raised slowly. Before the voltage of the capacitor C1 reaches to 0.7 volts (V), the transistor Q1 is turned off, in this period, the control terminal of the thyristor SCR is at a high voltage level, the thyristor SCR is turned on, therefore the ignition coil L is powered on. After a delay time (determined by the resistance of the resistor R1 and the capacitance of the capacitor C1), the voltage of the capacitor C1 reaches to 0.7 V, the transistor Q1 is turned on, the control terminal of the thyristor SCR is at a low voltage level, the thyristor SCR is turned off, therefore the ignition coil L is powered off. Therefore an ignition operation is accomplished.

In one embodiment, the diode D is used to protect the ignition coil L from reverse breakdown. In other embodiments, the diode D can be omitted to save costs. The transistor Q1 and the thyristor SCR can be replaced by other types of electrical switches.

Figure 2:
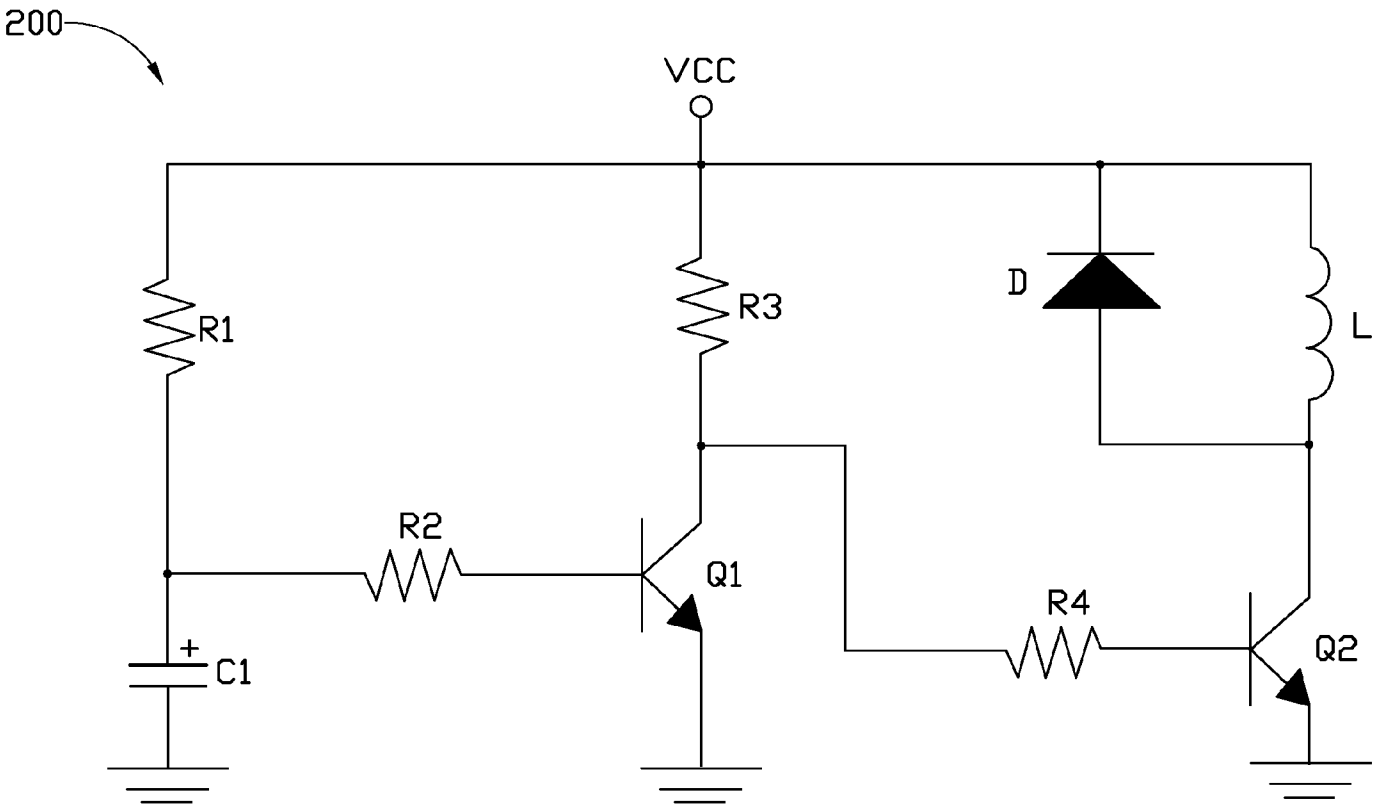
FIG. 2 is a circuit diagram of a second exemplary embodiment of an ignition circuit.

Referring to FIG. 2, a second exemplary embodiment of an ignition circuit 200 is shown. The ignition circuit 200 is similar to the ignition circuit 100, except that an npn transistor Q2 is provided to replace the thyristor SCR. In this embodiment, a base (control terminal) of the transistor Q2 is connected to the collector of the transistor Q1 via a resistor R4. An emitter of the transistor Q2 is grounded. A collector of the transistor Q2 is connected to the system power supply VCC via the ignition coil L. The working process of the ignition circuit 200 is similar to the working process of the ignition circuit 100, therefore the working process of the ignition circuit 200 is not described here.

Figure 3:
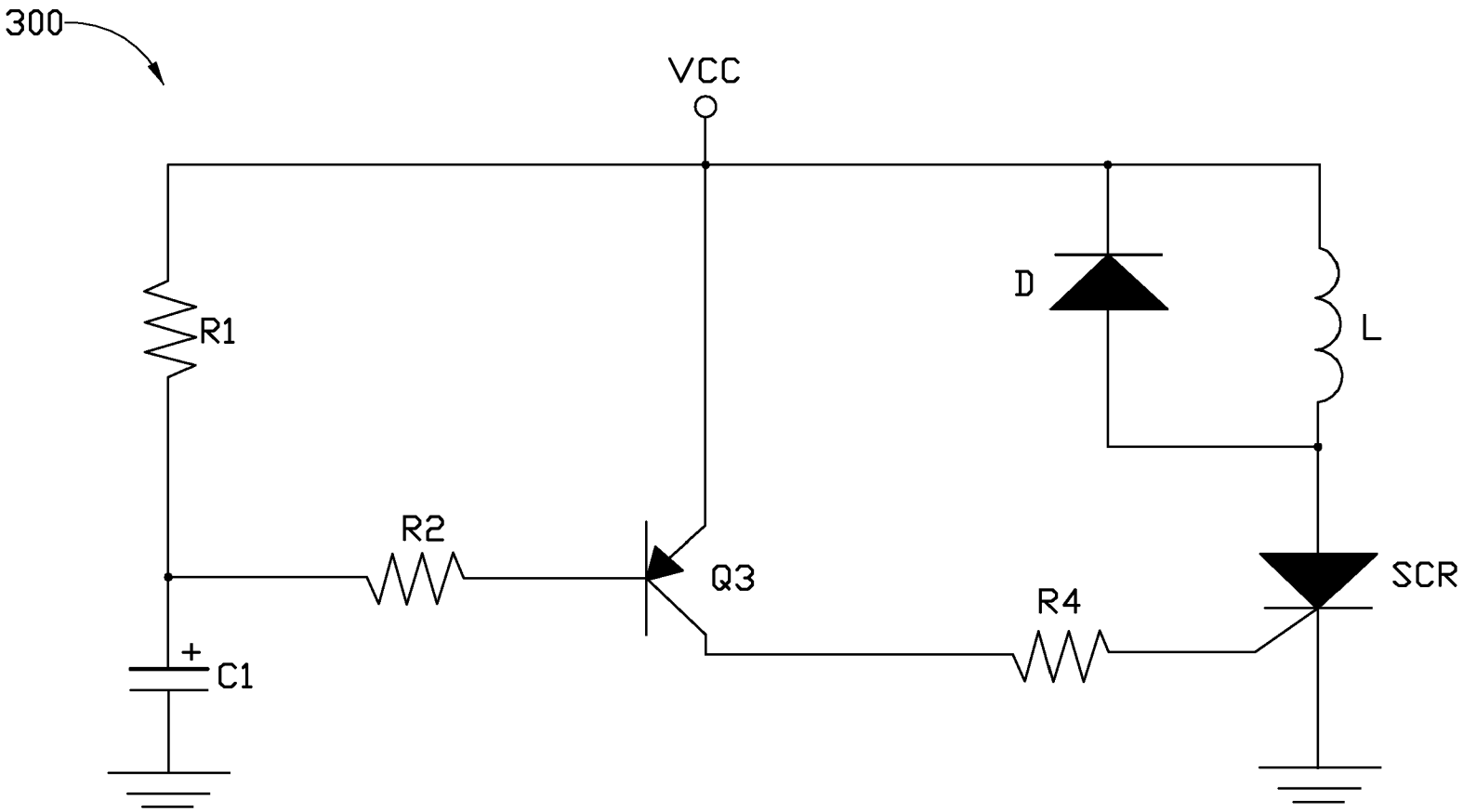
FIG. 3 is a circuit diagram of a third exemplary embodiment of an ignition circuit.

Referring to FIG. 3, a third exemplary embodiment of an ignition circuit 300 is shown. The ignition circuit 300 is similar to the ignition circuit 100, except that a pnp transistor Q3 is provided to replace the npn transistor Q1, and the resistor R3 is omitted. In this embodiment, a base of the transistor Q3 is connected to the node between the resistor R1 and the capacitor C1 via the resistor R2. An emitter of the transistor Q3 is connected to the system power supply VCC. A collector of the transistor Q3 is connected to the control terminal of the thyristor SCR via a resistor R4. The working process of the ignition circuit 300 is similar to the working process of the ignition circuit 100, therefore the working process of the ignition circuit 300 is not described here.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. An ignition circuit, comprising:

an ignition coil comprising a first terminal connected to a positive terminal of a system power supply, and a second terminal;

a delay unit;

a first switch unit comprising a first terminal connected to the positive terminal of the system power supply, a second terminal connected to ground, and a control terminal connected to the positive terminal of the system power supply via the delay unit; and a second switch unit connected in series with the ignition coil, wherein the second switch unit comprises a first terminal connected to the second terminal of the ignition coil, a second terminal connected to ground, and a control terminal connected to the first terminal of the first switch unit;

wherein the second switch unit is turned on in response to the system power supply being powered on, thereby the ignition coil is powered on, then the delay unit controls the first switch unit to be turned on after a delay time, the second switch unit is thus turned off, thereby the ignition coil is powered off.

2. The ignition circuit of claim 1, further comprising a diode, a cathode of the diode is connected to the first terminal of the ignition coil, an anode of the diode is connected to the second terminal of the ignition coil.

3. The ignition circuit of claim 1, wherein the delay unit comprises a first resistor and a capacitor, the system power supply is connected to a positive terminal of the capacitor and the control terminal of the first switch unit via the first resistor, a negative terminal of the capacitor is grounded.

4. The ignition circuit of claim 3, wherein the first switch unit comprises a first npn transistor, a base of the first npn transistor functioning as the control terminal of the first switch unit is connected to a node between the first resistor and the capacitor via a second resistor, a collector of the first npn transistor is connected to the system power supply via a third resistor and connected to the control terminal of the second switch unit via a fourth resistor, an emitter of the first npn transistor is grounded.

5. The ignition circuit of claim 4, wherein the second switch unit comprises a thyristor, a control terminal of the thyristor functioning as the control terminal of the second switch unit is connected to the collector of the first npn transistor via the fourth resistor, a cathode of the thyristor is grounded, an anode of the thyristor is connected to the second terminal of the ignition coil.

6. The ignition circuit of claim 4, wherein the second switch unit comprises a second npn transistor, a base of the second npn transistor functioning as the control terminal of the second switch unit is connected to the collector of the first npn transistor via the fourth resistor, an emitter of the second npn transistor is grounded, a collector of the second npn transistor is connected to the second terminal of the ignition coil.

7. The ignition circuit of claim 3, wherein the first switch unit comprises a pnp transistor, a base of the pnp transistor functioning as the control terminal of the first switch unit is connected to a node between the first resistor and the capacitor, an emitter of the pnp transistor is connected to the system power supply, a collector of the pnp transistor is connected to the control terminal of the second switch unit via a third resistor.

8. The ignition circuit of claim 7, wherein the second switch unit comprises a thyristor, a control terminal of the thyristor functioning as the control terminal of the second switch unit is connected to the collector of the pnp transistor, a cathode of the thyristor is grounded, an anode of the thyristor is connected to the second terminal of the ignition coil.

* * * * *